United States Patent [19]

Mazzola

[11] 3,965,559

[45] June 29, 1976

[54] FLAG TERMINAL APPLYING MACHINE

[75] Inventor: Ralph Mazzola, Boston, Mass.

[73] Assignee: Ark-Les Switch Corporation, Watertown, Mass.

[22] Filed: Mar. 6, 1975

[21] Appl. No.: 555,788

[52] U.S. Cl. ..... 29/203 DT; 29/203 DS; 29/628; 72/338; 72/339; 72/457; 113/119; 206/330

[51] Int. Cl.[2] ..... H01R 43/04

[58] Field of Search ..... 29/203 DT, 203 DS, 628, 29/630 A; 339/276 SF; 206/330; 113/119; 72/338, 339, 457, 461

[56] References Cited

UNITED STATES PATENTS

| | | | |
|---|---|---|---|
| 2,565,599 | 8/1951 | Elliott | 29/630 A |
| 2,802,194 | 8/1957 | Kirk | 339/276 SF |
| 3,030,694 | 4/1962 | Kerstetter et al. | 29/203 DT |
| 3,184,950 | 5/1965 | Sitz | 29/203 DS |
| 3,577,851 | 5/1971 | Detheridge | 29/605 |
| 3,672,025 | 6/1972 | Gudmestad | 29/203 DT |

FOREIGN PATENTS OR APPLICATIONS

| | | | |
|---|---|---|---|
| 710,007 | 5/1965 | Canada | 29/203 DT |

*Primary Examiner*—Carl E. Hall

[57] ABSTRACT

Apparatus for processing a terminal carrier strip comprising terminals attached sidewise to form the carrier strip, includes terminal carrier strip feed means for feeding the carrier strip in a carrier strip feed direction, and turning means cooperating with the terminal carrier strip feed means to turn a leading terminal through an angle relative to the carrier strip feed direction, to aid in attaching flag terminals to lengths of wire.

7 Claims, 17 Drawing Figures

FIG 9
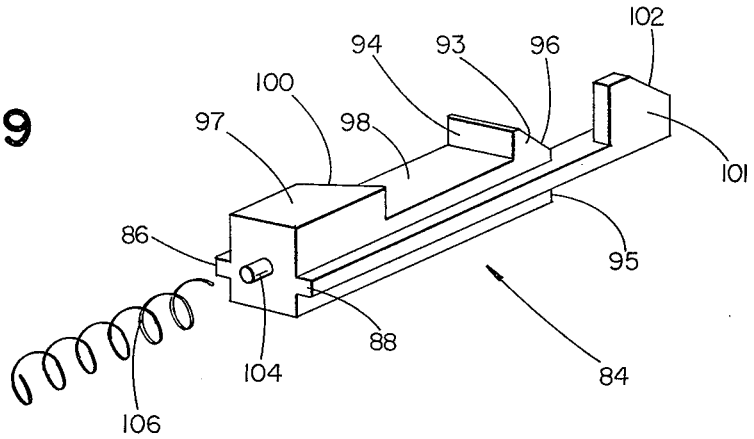
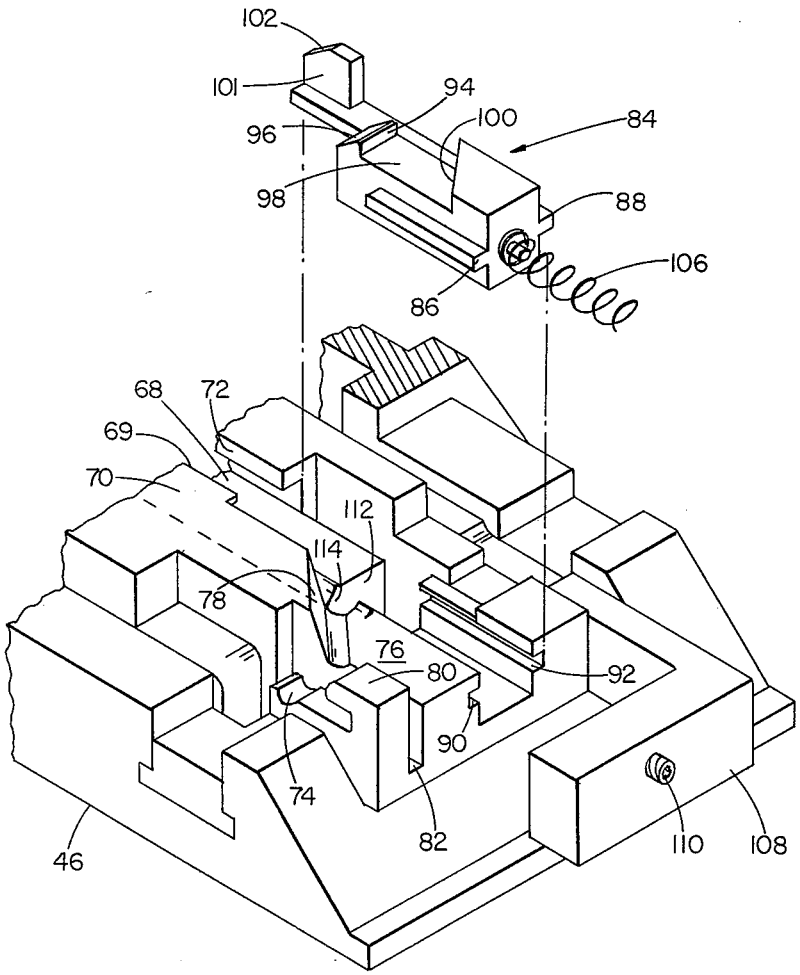
FIG 16

FLAG TERMINAL APPLYING MACHINE

This invention relates to apparatus used to apply terminals to both ends of a piece of wire. In particular, the invention relates to a modification of such apparatus to permit the application of flag terminals as well as in-line terminals to the wire.

The apparatus of the invention is a modification of a portion of an automatic terminal applying machine similar to that disclosed in U.S. Pat. No. 3,672,025, issued June 27, 1972. The machine disclosed in that patent provides means to attach in-line terminals to each end of a measured length of wire. For this purpose, the terminals are supplied atttached endwise to a carrier strip, which is fed at right angles to the direction of the wire feed. The wire-receiving portion of the in-line terminal is perpendicular to the direction of carrier strip feed. The cut and stripped wire end is laid in the open terminal, which is crimped over the wire. The assembled unit is detached from the carrier strip and removed, and the next terminal is fed into place to receive the next wire length.

It is desirable to be able to use apparatus such as that described in U.S. Pat. No. 3,672,025 to apply flag terminals as well as in-line terminals. Flag terminals are attached sidewise to one another to form a terminal strip, so that the wire-receiving portion is oriented parallel with the direction of carrier strip feed, rather than perpendicular to it. Consequently, the terminal to be attached must be fed directly toward the cut and stripped wire end. Further, it is desirable to be able to use the machine alternately for applying either sort of terminal, without major rebuilding of the machine.

It is therefore an object of this invention to provide a modified terminal applying machine that can apply a flag terminal to a piece of wire. It is also an object to provide such a modification in a terminal applicator unit that can be easily exhanged with an unmodified unit so that the machine can easily be adapted to apply either type of terminal alternately.

According to the present invention, apparatus is provided for processing a terminal carrier strip comprising terminals attached sidewise to form the carrier strip. The apparatus includes terminal carrier strip feed means for feeding the carrier strip in a carrier strip feed direction, and turning means cooperating with the terminal carrier strip feed means to turn a leading terminal through an angle relative to the carrier strip feed direction, to aid in attaching flag terminals to lengths of wire.

Preferably, the turning means includes punch means with the carrier strip between a selected terminal and the succeeding terminal in said strip, to partially sever and bend the strip, and the apparatus further includes separator means engageable with the succeeding terminal to prevent motion thereof during motion of the punch. In preferred embodiments the turning means further comprises angle guide means inclined at 45° to the carrier strip feed direction, and movable bending means engageable with the selected terminal in the carrier strip in an unturned position of the selected terminal, to bend the selected terminal against the angle guide means, the leading terminal being thereby turned through an angle of 90°.

In a particular preferred embodiment, an automatic terminal applying machine is provided for attaching flag terminals to lengths of wire. The terminals are supplied to the machine attached to one another in spaced, parallel relationship sidewise to form a strip. The machine has a terminal applicator that includes a base, a tool reciprocable with respect to the base, the tool and base defining a terminal attaching position and including cooperating terminal attaching means actuated on reciprocation of the tool, and terminal strip feed means for feeding the terminal strip in a strip feed direction to place a leading terminal in the terminal attaching position. The machine further has a wire feed assembly for supplying wire in a wire feed direction perpendicular to the strip feed direction to place a cut wire end in a leading terminal in the terminal attaching position. The machine provides turning means in the terminal applicator cooperating with the terminal strip feed means and actuated by reciprocation of the tool to turn a leading terminal through 90° relative to the strip feed direction and in the plane of the base before the leading terminal reaches the terminal attaching position, whereby the terminal applying machine is adapted to attach flag terminals to lengths of wire.

Preferably, each flag terminal has a metal body including a terminal-receiving portion and a wire-receiving portion including generally upright tabs, the terminals beings originally attached to one another in spaced parallel relationship sidewise at the wire receiving portions to form an extended terminal strip having a tab edge and including first, second and third terminals defined by position with respect to the leading free end of the terminal strip. Each terminal-receiving portion has a leading and trailing edge defined by advancement of the terminal strip. The terminal applicator base provides a terminal strip feed path having a tab edge to receive the strip tab edge. The reciprocable tool provides a cam surface, and the machine provides reciprocating means to move the tool sequentially through a first downstroke, a dwell, a further downstroke, and an upstroke. The cooperating terminal attaching means is actuated on the tool further downstroke, and the terminal strip feed means is actuated on the tool upstroke for advancing the terminal strip along the terminal strip feed path. The wire feed assembly places the cut wire end in the wire-receiving portion of a first terminal in the terminal attaching position during the tool motion dwell.

The turning means comprises a generally upright angle guide surface on the base between the terminal attaching position and the strip feed path tab edge, and inclined at 45° to the strip feed path and to the wire feed path, severing means carried on the tool engageable with the terminal strip between the second and third terminals on the first tool downstroke to partially sever the strip, stop means engageable with the leading edge of the terminal-receiving portion of the third terminal on the first tool downstroke to prevent forward motion of the third terminal, and bending means. The bending means is engageable with the trailing edge of the terminal-receiving portion of a second terminal in the terminal strip advanced by the feed means, and includes a cam follower surface engageable with the tool cam surface on the first tool downstroke to move the bending means in the plane of the base parallel with the strip feed path, to move the second terminal forward, forcing its tab against the angle guide surface to bend the second terminal in the plane of the base at an angle of 45° to the third terminal, and to advance the first terminal to the terminal attaching position to receive the cut wire end for attachment thereto.

Other objects, features and advantages will appear from the following description of a preferred embodiment of the invention, taken together with the attached drawings thereof, in which:

FIG. 9 is a detailed view of the bending means;

FIG. 16 is a detailed view of a portion of the base, showing the placement of the bending means therein.

The apparatus of the invention is a modification of a portion of an automatic terminal applying machine similar to that disclosed in U.S. Pat. No. 3,672,025, issued June 27, 1972. The machine disclosed in that patent provides means to attach in-line terminals to each end of a measured length of wire. For this purpose, the terminals are supplied attached endwise to a carrier strip, which is fed at right angles to the direction of the wire feed. The wire-receiving portion of the in-line terminal is perpendicular to the direction of carrier strip feed. The cut and stripped wire end is laid in the open terminal, which is crimped over the wire. The assembled unit is detached from the carrier strip and removed, and the next terminal is fed into place to receive the next wire length.

The modification of the present invention permits this or similar apparatus to attach flag terminals to the ends of lengths of wire. Flag terminals are attached sidewise to one another to form a terminal strip, so that the wire-receiving portion is oriented parallel with the direction of carrier strip feed, rather than perpendicular to it, as with in-line terminals. Consequently, the terminal to be attached must be fed directly toward the cut and stripped wire end.

Figure 1:
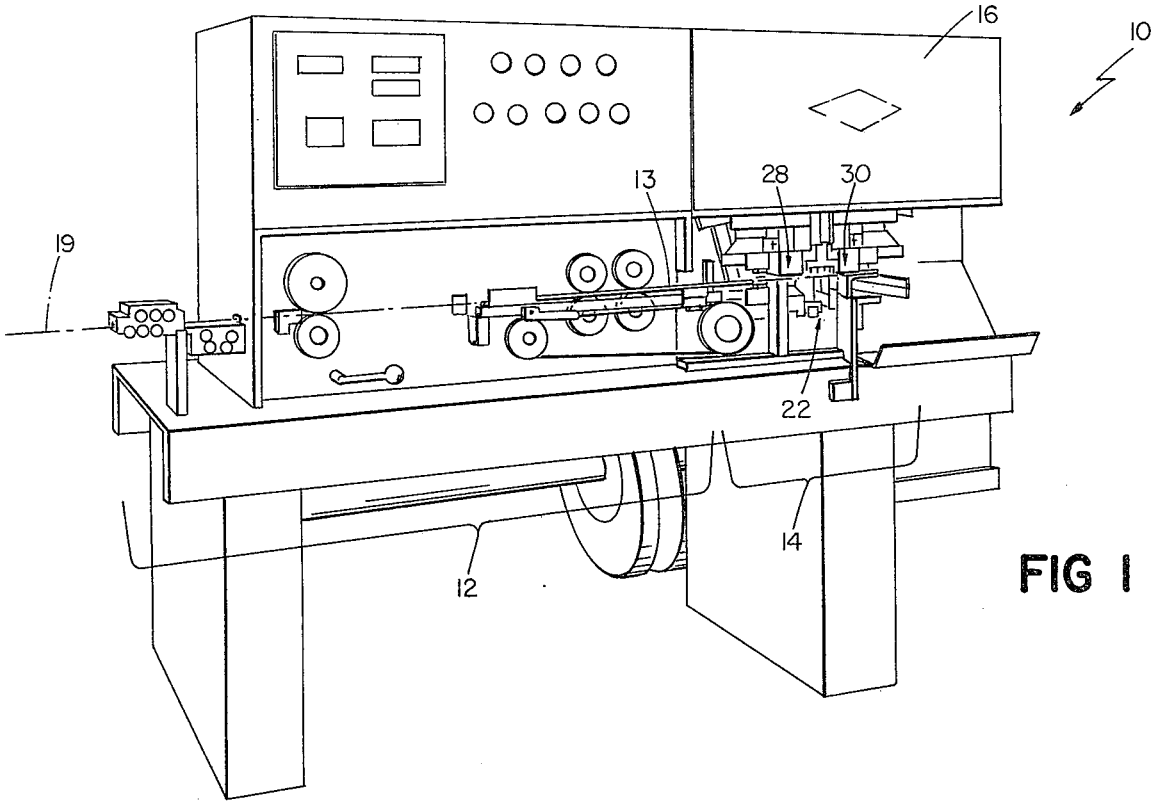
FIG. 1 is a perspective view of the terminal applying machine.

Referring now to FIG. 1, a modified machine 10 is shown, which includes generally a wire metering and feed assembly 12 similar in essentials to that of U.S. Pat. No. 3,672,025, and a terminal attaching assembly 14. Assembly 14 is seen in greater detail in FIG. 2. Panel 16 has been removed to show the cam shaft 18 and nine pairs of cams 20, which control in a conventional manner the operations of the components of assembly 14. These components include cutter assembly 22 and clamps 24 and 26, all similar in essentials to those of U.S. Pat. No. 3,672,025, and terminal applicators 28 and 30 to either side of cutter assembly 22. Either or both of terminal applicators 28 and 30 may be modified according to the present invention to permit the application of flag terminals. The present disclosure describes a modification of applicator 28. The modification of applicator 30 is similar, but the orientation of the wire end and terminal is in effect a mirror image of that of applicator 28.

Figure 2:
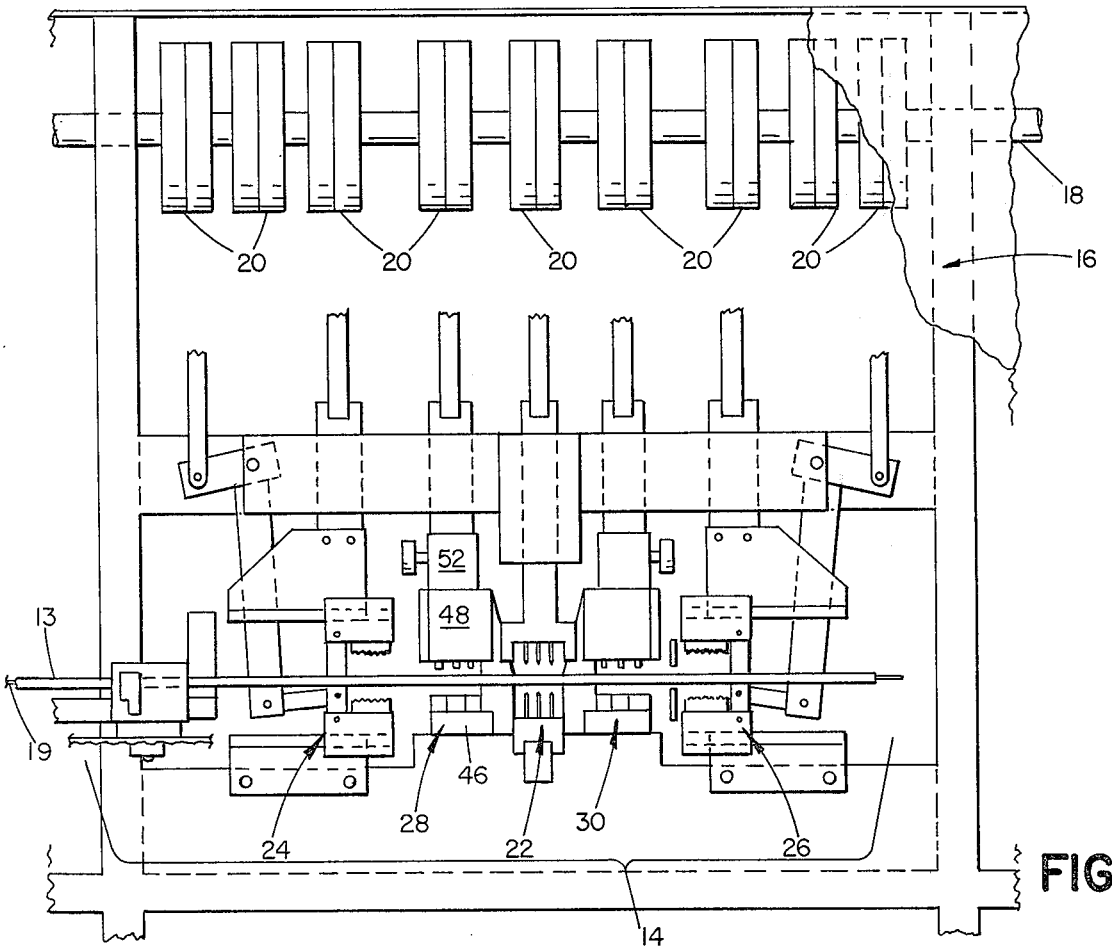
FIG. 2 is a detail of FIG. 1, with cover plate removed.

In general terms, the machine of the invention operates like the machine of U.S. Pat. No. 3,672,025. During a 360° rotation of cam shaft 18, wire guide tube 13 first advances (to the right as seen in FIGS. 1 and 2) past assembly 14, whose cutters, applicators and clamps are all open. Insulated wire is supplied at 19 and is fed through guide tube 13, with a terminal from the previous cycle of operation attached to the leading end of the wire. The distance to which the wire is advanced through guide tube 13 is determined by the metering apparatus of assembly 12. Feed means in applicators 28 and 30 advance a terminal into crimping position in each applicator. Wire guide tube 13 is withdrawn and the wire is held by clamps 24 and 26. Cutter assembly 22 is closed to sever the insulated wire and to cut through the insulation at two points on either side of the point of severance to permit stripping. Clamps 24 and 26 retract the severed portions of wire to provide the stripping action and to lay the stripped ends in the terminals positioned in terminal applicators 28 and 30. Applicators 28 and 30 are then operated to attach terminals to the two cut and stripped wire ends, and the free section of wire (to the right of cutter assembly 22) including attached terminals at both ends, is removed. The wire guide tube advances again and the cycle is repeated.

Figure 3:
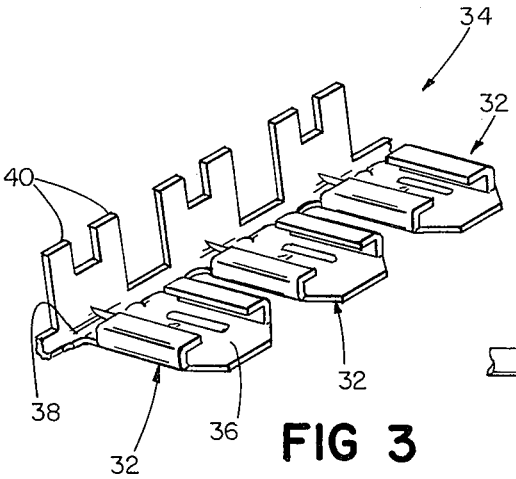
FIGS. 3 and 4 are perspective and plan views of flag terminals of the type applied by a machine modified according to the invention.
Figure 4:
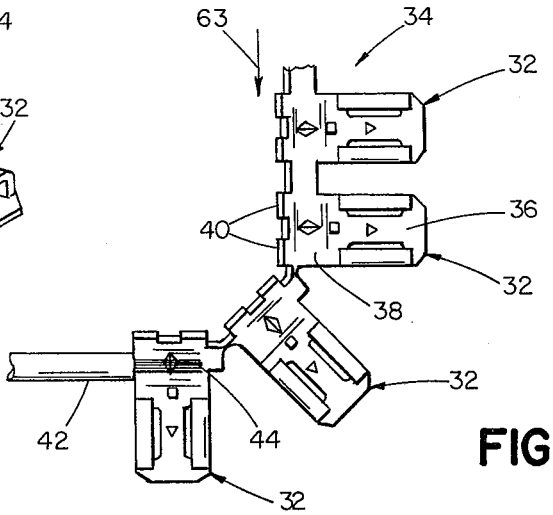

Referring now to FIGS. 3 and 4, each flag terminal 32 includes a terminal receiving portion 36 and a wire-receiving portion including a trough 38, in which the wire end is laid, and generally upright tabs 40, which are crimped over the wire end to attach the terminal to the wire. Terminals 32 are attached sidewise to one another at the wire receiving portions to form a terminal strip 34 having a tab edge. The terminal strip includes first, second and third terminals defined by their position with respect to the leading free end of the terminal strip. Each terminal-receiving portion has a leading edge and a trailing edge defined by the direction of advancement of the terminal strip in machine 10.

According to the invention, the modification of machine 10 provides means in the terminal applicator 28 to turn each flag terminal through two successive angles of 45° from the direction in which terminal strip 34 is fed, bringing the leading (first) terminal into a position in which trough 38 is parallel with the wire 42 whose stripped end 44 is to be laid in the wire-receiving portion of the terminal 32.

Figure 5:
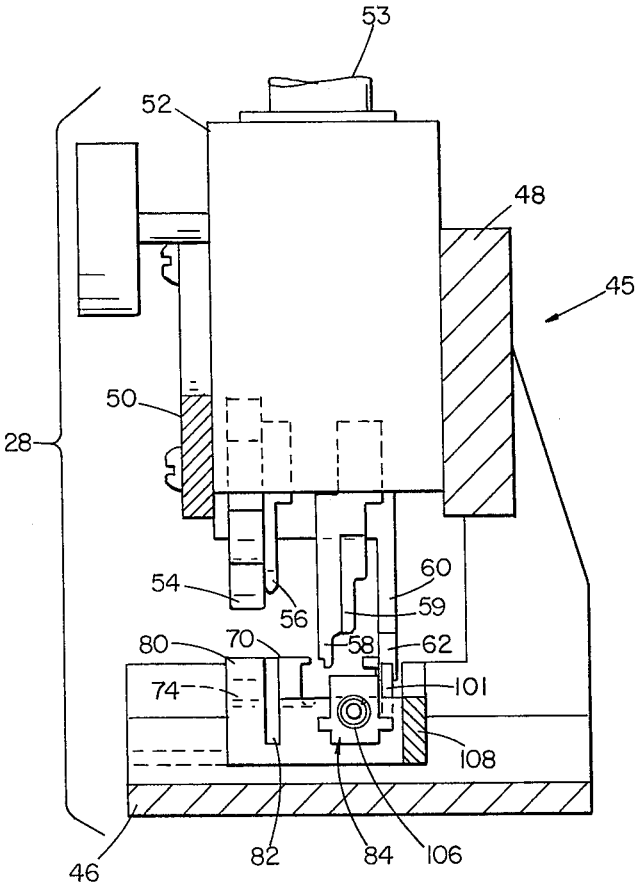
FIGS. 5 and 6 are front and side elevations of a modified terminal applicator unit in the terminal applying machine.
Figure 6:
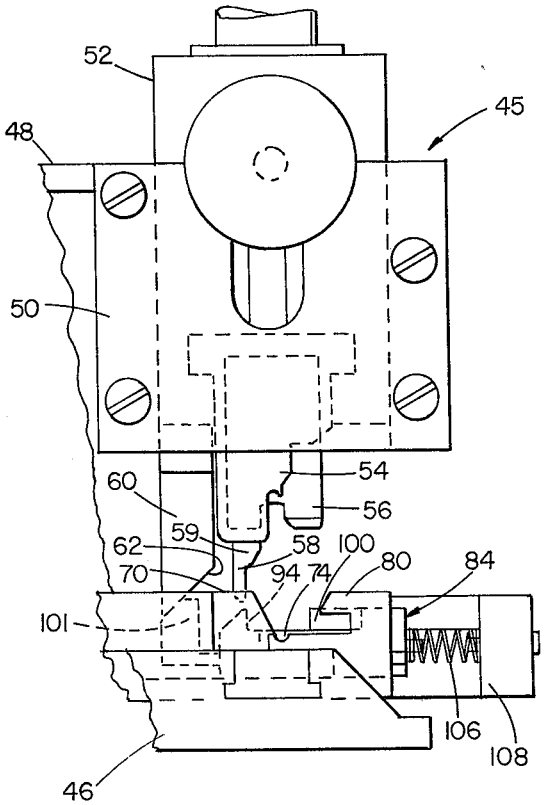
Figure 8:
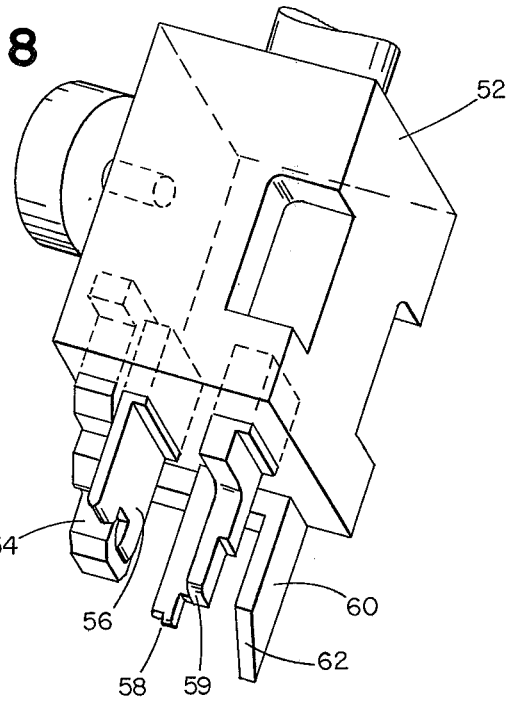
FIG. 8 is a detailed view of the reciprocable tool of the modified terminal applicator unit.

Terminal applicator 28, referring now particularly to FIGS. 5 and 6, includes a housing 45 having a base 46 and a tool guide portion 48, including a removable front plate 50. Tool 52 is reciprocated by a ram, indicated at 53, within guide portion 48, toward and away from base 46, and moves sequentially through a first downstroke, a dwell, a further downstroke, and an upstroke. Tool 52 carries a crimper 54, cutter 56, punch 58 (severing means), separator 59 (stop means), and cam 60 having a cam surface 62 (FIG. 8).

Figure 7:
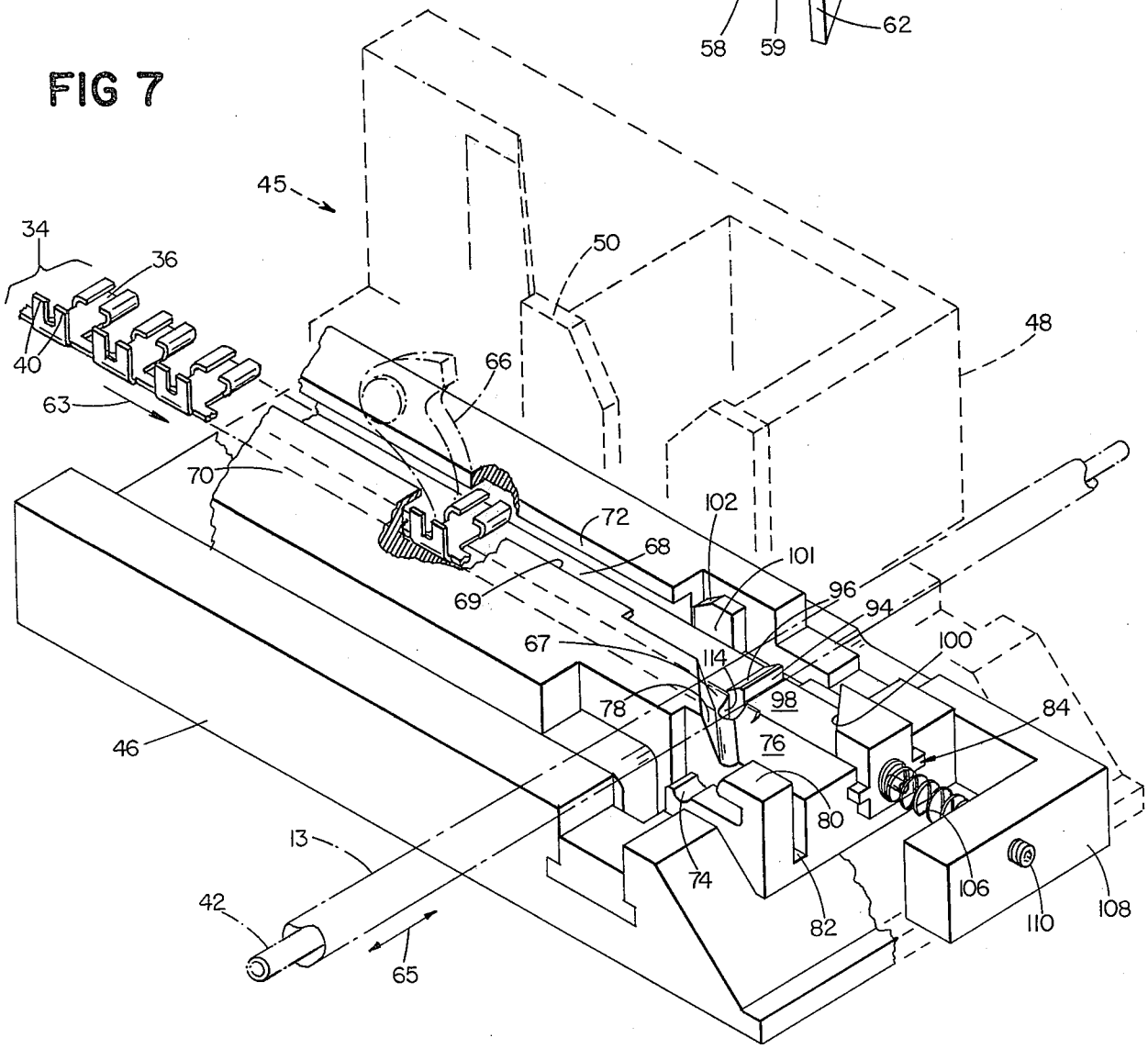
FIG. 7 is a detailed view of the base of the modified terminal applicator unit.

Base 46 is best seen in FIG. 7. A strip of terminals is supplied at 34. Feed finger 66 is secured to housing 45 and is actuated in a conventional manner on the upstroke of tool 52 to advance the terminal strip by one terminal in the direction of arrow 63. The terminals advance along a terminal feed path 68, including feed path trough 67 which receives terminal trough portion 38 (FIG. 3), The terminals are retained on path 68 by the overhang 69 of internal base wall 70, which confines tab 40, and by rear retainer 72, which confines the ends of terminal-receiving portions 36. Trough 67 and overhang 69 form a feed path tab edge. Feed path 68 is terminated by a vertical stop surface 112 (visible in FIG. 16).

The position of wire guide tube 13 is shown in phantom at a right angle to the direction of feed of the terminal strip. Wire guide tube 13 reciprocates in the direction of double-headed arrow 65. Base 46 includes a crimping anvil 74, oriented parallel with arrow 65 and beneath the position of guide tube 13. Base crimping anvil 74 and tool crimper 54 and cutter 56 define a terminal attaching position and act as cooperating terminal attaching means actuated at the bottom of the further downstroke of tool 52. An end-retaining portion 80 on base 46 confines the end of terminal-receiving portion 36 of each terminal as its tabs 40 are crimped over wire 42 against anvil 74.

Internal base wall 70 provides a generally flat turning surface 76, adjacent to and coplanar with feed path 68, and further includes a generally upright angle guide surface 78 sloping downward to turning surface 76. As best seen in the plan view of FIG. 10, the line of angle guide surface 78 is at an angle of 45° to the line of anvil 74, and is also at 45° to the direction of feed path 68. Turning surface 76 of wall 70 is spaced at 82 from end retaining portion 80 and anvil 74, to accommodate cutter 56 on the further downstroke of tool 52. A punch recess 114 is provided in turning surface 76 adjacent stop surface 112 of feed path 68, to accommodate punch 58 on the first and further downstroke of tool 52.

Figure 10:
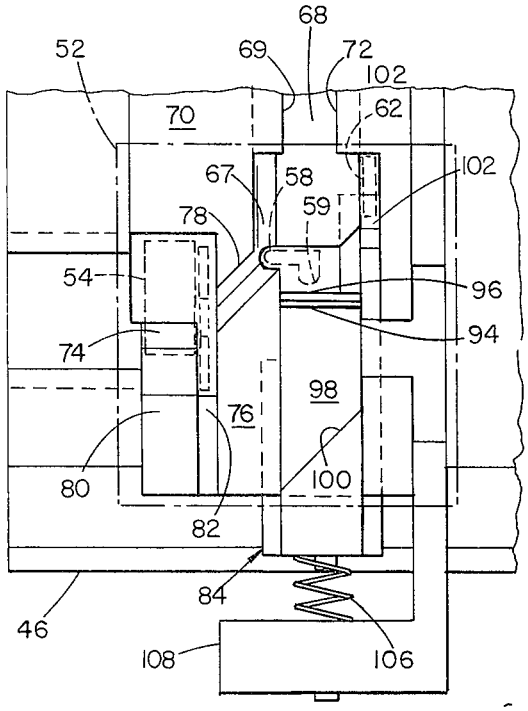
FIG. 10 is a plan view showing the relationship of portions of the base and tool during operation of the machine.

A bending means of slider 84 (FIG. 9) is reciprocable parallel with arrow 63, between stop surface 112 and base arm 108, and adjacent turning surface 76. Slider 84 provides tongues 86 and 88 which slide in grooves 90 and 92 of base 46 (FIG. 16). Slider 84 further provides a rear pulling end 93 having a vertical pulling surface 94, a vertical end surface 95, and a beveled end surface 96. Slider 84 has a forward end 97 including a generally upright slider angle guide surface 100, which, as seen in FIG. 10, is parallel with the line of angle guide surface 78 of base wall 70. Between rear pulling end 93 and slider angle guide surface 100 is a slider turning surface 98, which is generally coplanar with turning surface 76 of wall 70 and with feed path 68.

Forward end 97 of slider 84 provides a centering pin 104. Base arm 108 provides a screw 110. Spring 106 is centered on pin 104 and screw 110, and is confined between slider 84 and base arm 108.

Tongue 88 is prolonged beyond slider pulling end 93 and provides a camming end 101 having a camming surface 102. On the first downstroke of tool 52, cam surface 62 of tool cam 60 engages slider camming surface 102 and forces slider 84 forward, compressing spring 106. On the upstroke of tool 52, spring 106 returns slider 84 to its home position in which slider end surface 95 engages slider stop surface 112 of base 46.

FIG. 10 shows a plan view of the relevant elements of housing base 46 and their relationship to the operative components of tool 52, shown in phantom. At the bottom of the further downstroke of tool 52 (about 220° in FIG. 17), crimper 54 reaches anvil 74, cutter 56 is received in space 82, and punch 58 is received in punch recess 114. Separator 59 enters the space between stop surface 110 and slider pulling end 93 as the slider moves forward. Tool camming surface 62 engages slider camming surface 102 and forces slider 84 to its extreme forward position.

Figure 11:
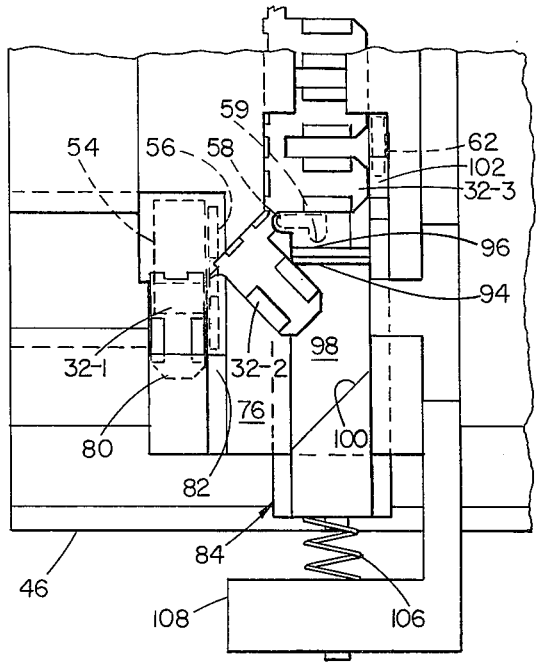
FIGS. 11, 12, 13, 14 and 15 are views similar to FIG. 10 with a terminal strip in place.
Figure 12:
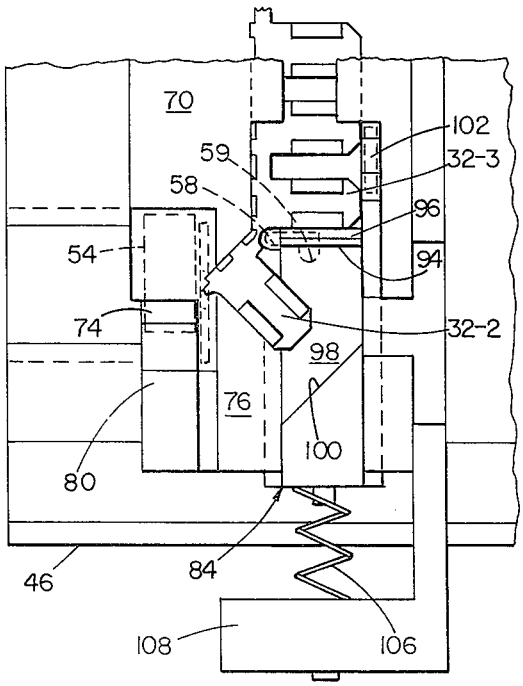

FIG. 11 shows the elements of FIG. 10 in the same relationship, as the bottom of the downstroke of tool 52, but with a strip of terminals in place. The first terminal 32-1 has been crimped over a wire 42 and has been severed from the terminal strip by cutter 56. A second terminal 32-2 has been bent by slider pulling surface 93 through an angle of 45° from the feed path of the terminal strip, and punch 58 has punched out a portion of carrier strip 34 between terminals 32-2 and 32-3 to partially sever the second from the third terminal. Separator 59 acts as a stop to hold back terminal 32-3 against the pull of slider 84.

Figure 13:
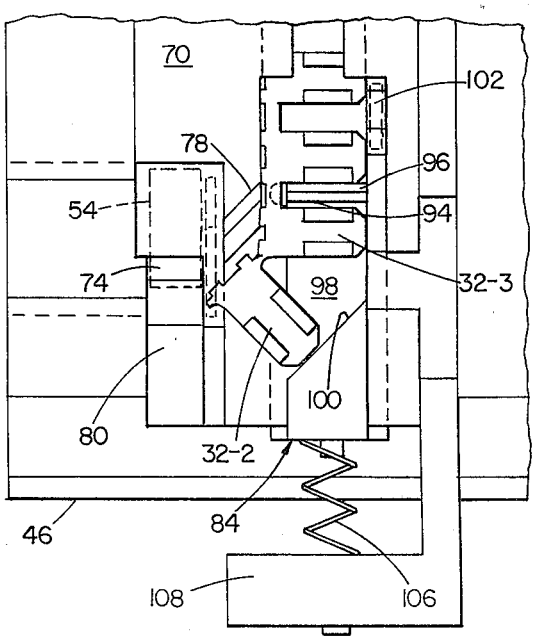
Figure 14:
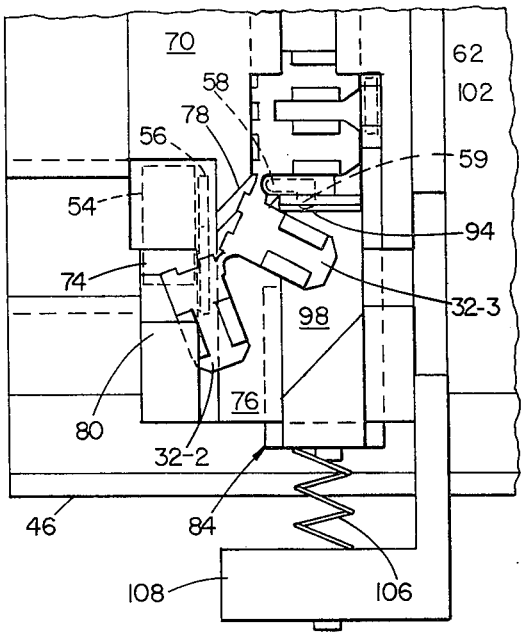
Figure 15:
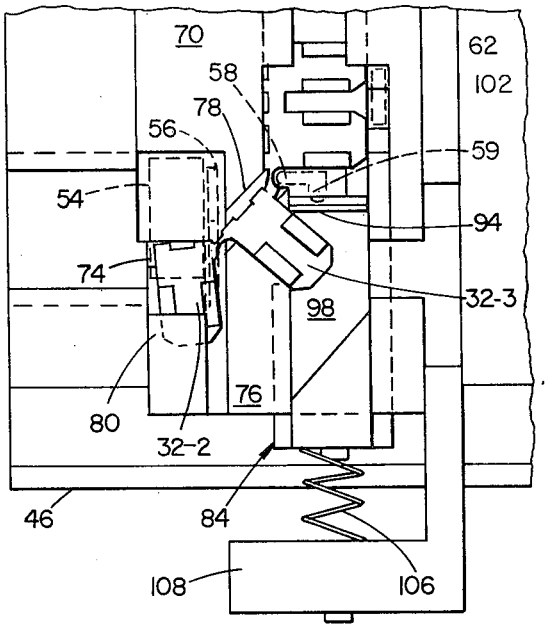
Figure 17:
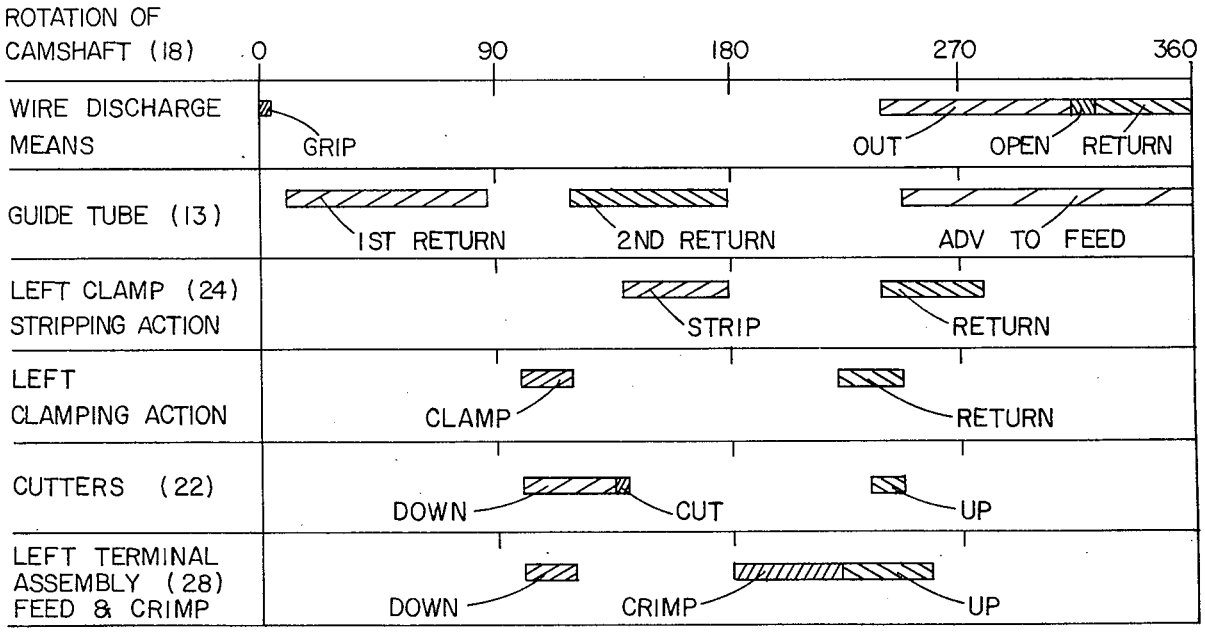
FIG. 17 is a timing diagram of the operation of the terminal applying machine.

Referring now to FIG. 17, which shows the timing relationships of the relevant operative elements of machine 10, and to FIGS. 13 to 15, FIG. 13 shows the machine elements at about 280° rotation of cam shaft 18. The upstroke of tool 52 in applicator 28 has been completed. Slider 84 is in its home position. The feed finger has operated to advance the terminal strip by one terminal, causing terminal 32-3 to ride up over beveled end surface 96 of slider 84 and to engagepulling surface 94. The guide tube 13 is now advanced to the right, as previously described, and wire is metered out through tube 13.

The wire guide tube 13 is withdrawn (90° rotation of the cam shaft), and clamps 24 and 26 close to clamp the wire. Tool 52 moves down through its first downstroke, and punch 58 is received in punch recess 114 (FIG. 14) as slider 84 begins to move forward. At the same time, cutter assembly 22 begins to close. The wire is held in clamps 24 and 26 and clears the surfaces of base 46, while slider 84 continues forward (FIG. 15) bending terminal 32-3 through 45°. The bend is shown incomplete in FIG. 15. Completion of the forward motion of slider 84 forces tabs 40 of terminal 32-3 against angle guide surface 78 and bends the terminal through 45°. Terminal 32-2 is moved onto anvil 74 by the angular motion of terminal 32-3 through 45°.

The downstroke of tool 52 is interrupted, after terminal 32-2 has been moved into position on anvil 74, and tool 52 dwells while guide tube 13 is withdrawn further and the cut strip action of cutter assembly 22 and clamps 24 and 26 is completed. The cut and stripped end of the wire is laid into the open terminal 32-2 (180°) and the downstroke of tool 52 is then continued to crimp the terminal over the wire end and to sever the terminal from the strip (FIG. 11).

What is claimed is:

1. In an automatic terminal applying machine for attaching terminals to lengths of wire, said terminals being supplied to said machine attached sidewise to one another to form a terminal strip, said machine having a terminal applicator including a base, a tool reciprocable with respect to said base, said tool and base defining a terminal attaching position and including cooperating terminal attaching means actuated on reciprocation of said tool, and terminal carrier strip feed means for feeding said carrier strip in a carrier strip feed direction to place a leading terminal in said terminal attaching position, and a wire feed assembly for supplying wire in a wire feed direction perpendicular to said carrier strip feed direction to place a cut wire end in a said leading terminal in said terminal attaching position in said terminal applicator, that improvement comprising turning means in said terminal applicator cooperating with said terminal carrier strip feed means and actuated by reciprocation of said tool to turn a said leading terminal through 90° relative to said carrier strip feed direction before said leading terminal reaches said terminal attaching position, whereby said terminal applying machine is adapted to attach flag terminals to lengths of wire.

2. A strip terminal processing apparatus for bending a strip of terminals each having a metal body including a terminal-receiving portion and wire-receiving portion including generally upright tabs, said terminals being attached to one another in spaced parallel relationship to form a terminal strip extending perpendicularly to said terminals and having a tab edge and including first, second and third terminals, defined by position with respect to the leading advancing free end of said terminal strip, said apparatus including a base providing a terminal strip feed path having a tab guiding edge to guide said strip tab edge, terminal strip feed means for advanccing said terminal strip along said terminal strip feed path, turning means for turning successive leading terminals in a direction perpendicular to said feed path comprising severing means engageable with said terminal strip between said second and third terminals to partially sever said strip, and bending means engageable with the terminal-receiving portion of a said terminal strip advanced by said feed means, to bend said second terminal in the plane of said base at an angle of 45° to said third terminal, and simultaneously to advance said first terminal.

3. The improvememt as claimed in claim 2 further including stop means engageable with the terminal-receiving end of said third terminal.

4. The improvement as claimed in claim 3 further including a generally upright angle templet on said base between said terminal attaching position and said strip feed path tab edge, and inclined at 45° to said strip feed path and to said wire feed path.

5. In an automatic terminal applying machine for attaching flag terminals to lengths of wire, each said flag terminal having a metal body including a terminal-receiving portion and a wire-receiving portion including generally upright tabs, said terminals being attached to one another in spaced parallel relationship at said wire receiving portions to form a terminal strip extending perpendicularly to said terminals and having a tab edge and including first, second and third terminals, defined by position with respect to the leading advancing free end of said terminal strip, said machine having a terminal applicator including a base providing a terminal strip feed path having a tab guiding edge to guide said strip tab edge, a tool reciprocable with respect to said base, said tool and base defining a terminal attaching position and including cooperating terminal and wire attaching means actuated at said terminal attaching position, and terminal strip feed means for advancing said terminal strip along said terminal strip feed path, the improvement comprising turning means for turning successive leading terminals in a direction perpendicular to said feed path for presentation to said tool at said terminal attaching position, comprising severing means engageable with said terminal strip between said second and third terminals to partially sever and strip, and bending means engageable with the terminal-receiving portion of a said second terminal in said terminal strip advanced by said feed means, to bend said second terminal in the plane of said base at an angle of 45° to said third terminal, and simultaneously to advance said first terminal to said terminal attaching position to receive a wire end for attachment thereto.

6. An automatic terminal applying machine for attaching flag terminals to lengths of wire, each said flag terminal having a metal body including a terminal-receiving portion and a wire-receiving portion including generally upright tabs, said terminals being originally attached to one another in spaced parallel relationship sidewise at said wire receiving portions to form an extended terminal strip having a tab edge and including first, second and third terminals defined by position with respect to the leading free end of said terminal strip, each said terminal-receiving portion having a leading and a trailing edge defined by advancement of said terminal strip, said machine having a terminal applicator including a base providing a terminal strip feed path having a tab edge to receive said strip tab edge, a tool reciprocable with respect to said base and providing a cam surface, said tool and base defining a terminal attaching position spaced from said terminal strip feed path, reciprocating means to move said tool sequentially through a first downstroke, a dwell, a further downstroke, and an upstroke, said tool and base including cooperating terminal attaching means actuated at said terminal attaching position on said tool further downstroke, and terminal strip feed means actuated on said tool upstroke for advancing said terminal strip along said terminal strip feed path, a wire feed assembly for supplying wire in a wire feed direction perpendicular to said strip feed path to place a cut wire end in the wire-receiving portion of a said first terminal in said terminal attaching position during said tool motion dwell, and turning means in said terminal applicator comprising a generally upright angle guide surface on said base between said terminal attaching position and said strip feed path tab edge, and inclined at 45° to said strip feed path and to said wire feed path, serving means carried on said tool engageable with said terminal strip between said second and third terminals on said first tool downstroke to partially sever said strip, stop means engageable with the leading edge of the terminal-receiving portion of said third terminal on said first tool downstroke to prevent forward motion of said third terminal, and bending means engageable with the trailing edge of the terminal-receiving portion of a said second terminal in said terminal strip advanced by said feed means, and including a cam follower surface engageable with said tool cam surface on said first tool downstroke to move said bending means in the plane of said base parallel with said strip feed path to move said second terminal forward forcing its said tabs against said angle guide surface to bend said second terminal in the plane of said base at an angle of 45° to said third terminal, and to advance said first terminal to said terminal attaching position to receive said cut wire end for attachment thereto.

7. In an automatic terminal applying machine for attaching terminals to lengths of wire, said terminals being supplied to said machine attached sidewise to one another to form a terminal strip, including first, second and third terminals, defined by position with respect to the leading advancing free end of said terminal strip, said machine having a terminal applicator including a base, a tool reciprocable with respect to said base, said tool base defining a terminal attaching position and including cooperating terminal attaching means actuated on reciprocation of said tool, and terminal carrier strip feed means for feeding said carrier strip in a carrier strip feed direction to place a leading terminal in said terminal attaching position, and a wire feed assembly for supplying wire in a wire feed direction perpendicular to said carrier strip feed direction to place a cut wire end in a said leading terminal in said terminal attaching position in said terminal applicator, that improvement comprising turning means in said terminal applicator cooperating with said terminal carrier strip feed means and actuated by reciprocation of said tool to turn a said leading terminal through 90° relative to said carrier strip feed direction before said leading terminal reaches said terminal attaching position, comprising angle guide means on said base, inclined at 45° to said carrier strip feed direction and to said wire feed direction, a slider reciprocable in the plane of said base past said angle guide means, and engageable with a said second terminal on said carrier strip in an unturned position of said second terminal, said slider including a cam follower surface, punch means carried on said tool engageable with said carrier strip between said second and third terminals on reciprocation of said tool to partially sever said strip, and separator means carried on said tool engageable with said third terminal to prevent motion thereof during reciprocation of said slider, said tool including a cam surface engageable with said slider cam follower surface during reciprocation of said tool to reciprocate said slider, for bending said second terminal against said angle guide means, whereby said terminal applying machine is adapted to attach flag terminals to lengths of wire.

* * * * *

UNITED STATES PATENT AND TRADEMARK OFFICE

CERTIFICATE OF CORRECTION

PATENT NO. : 3,965,559

DATED : June 29, 1976

INVENTOR(S) : Ralph Mazzola

It is certified that error appears in the above-identified patent and that said Letters Patent are hereby corrected as shown below:

Col. 1, line 39, change "exhanged" to --exchanged--;

Col. 2, line 25, "beings" should be --being--;

Col. 5, line 35, change "of" to --or--;

Col. 6, line 6, change "as" to --at--;

line 25, "engagepull-" should be --engage pull- --;

Col. 7, line 28, change "advanccing" to --advancing--;

line 37, after "said", insert --second terminal in said--;

Col. 8, line 67, "serving" should be --severing--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*